US009663927B2

(12) United States Patent
Lo

(10) Patent No.: US 9,663,927 B2
(45) Date of Patent: May 30, 2017

(54) FAUCET DIVERTER

(71) Applicant: YUAN-MEI CORP., Changhua County (TW)

(72) Inventor: Shun-Nan Lo, Changhua County (TW)

(73) Assignee: YUAN-MEI CORP., Changhua County (TW)

( * ) Notice: Subject to any disclaimer, the term of this patent is extended or adjusted under 35 U.S.C. 154(b) by 337 days.

(21) Appl. No.: 14/316,089

(22) Filed: Jun. 26, 2014

(65) Prior Publication Data

US 2015/0376879 A1 Dec. 31, 2015

(51) Int. Cl.
*E03C 1/02* (2006.01)
*E03C 1/08* (2006.01)

(52) U.S. Cl.
CPC ..... *E03C 1/08* (2013.01); *E03C 1/023* (2013.01)

(58) Field of Classification Search
CPC ..... E03C 1/08; E03C 1/023; E03C 2201/30; B05B 1/185; F16K 11/074; F16K 3/08; F16K 3/085
USPC ..... 239/581.1; 137/625.46
See application file for complete search history.

(56) References Cited

U.S. PATENT DOCUMENTS 7,509,976 B2 * 3/2009 McNerney ..... F16K 11/0743 137/625.11
8,191,185 B2 * 6/2012 Tsai ..... E03C 1/0408 239/444
2006/0242759 A1 * 11/2006 Tsai ..... E03C 1/06 4/605
2008/0022450 A1 * 1/2008 Tsai ..... E03C 1/023 4/570
2012/0145810 A1 * 6/2012 Zhou ..... B05B 1/1645 239/443
2013/0126645 A1 * 5/2013 Zhou ..... B05B 1/18 239/581.1
2014/0076445 A1 * 3/2014 Zhou ..... E03C 1/023 137/874

* cited by examiner

*Primary Examiner* — Arthur O Hall
*Assistant Examiner* — Juan C Barrera
(74) *Attorney, Agent, or Firm* — Raymond Y. Chan; David and Raymond Patent Firm

(57) ABSTRACT

A faucet diverter is revealed. The faucet diverter includes at least one outlet and a control part for switching direction of water flow discharged. The faucet diverter is connected to a faucet.

4 Claims, 9 Drawing Sheets

FAUCET DIVERTER

BACKGROUND OF THE INVENTION

Fields of the Invention

The present invention relates to a faucet diverter, especially to a faucet diverter connected to an outlet of a faucet and having a control part for switching an outlet part and changing a channel water flow passes.

Descriptions of Related Art

Generally, a faucet diverter for discharging water is connected to a faucet and used broadly. Refer to Japanese Pat. JP2011-6014, a faucet connector is disclosed. The faucet connector includes an input end and two screw holes. The inlet end is coupled to an upper part of a main body of a faucet to connect to a faucet pipe. The screw holes allow water flowing into and out the coupled main body mentioned above. The faucet connector is used on the faucet with flow paths for switching water outlet path. The water outlet path is switched between two flow paths and connected to the input end and the screw holes mentioned above. The connector is a discharge device, allowing the water flow to be discharged through one of the screw holes.

The control member of the connector for switching the flow paths is a valve seat. A discharge channel switching unit includes a movable member that moves along an axis of a cylindrical part. An operation member is connected to a base end of the axis and disposed on the cylindrical part moveably. While rotating the operation member, the cylindrical part is moved axially. The operation member is connected to the cylindrical part by threads, able to rotate and unable to move along the axial direction. That means the operation member is positioned along the axial direction while the cylindrical part is moveable along the axial direction. When the operation member is rotated, it pushes the cylindrical part to move axially. Now one of the water channels is closed by a ball on the cylindrical part. Thus the water is discharged through the other channel.

However, the ball on the cylindrical part is leaning against by a spring. After being used for a long period, a problem of elastic fatigue happens. Thus the water channel is unable to be closed completely. And a water leakage problem occurs. Moreover, a water pressure is accumulated in the water channel while the water flow is discharged. The water pressure accumulated also pushes the ball. This is another factor that causes water leakage of the closed water channel.

SUMMARY OF THE INVENTION

Therefore it is a primary object of the present invention to provide a faucet diverter in which a control part for switching water flow is improved to be operated smoothly along the direction of water discharged. A sprayer and a multidirectional connector for connection of a soft hose are arranged at a regular discharge outlet. A control function that stops water spray is added to the sprayer.

The faucet diverter features on the control part for water discharge. In other words, the faucet diverter available now includes no control assembly for changing direction of the water flow discharged.

In order to achieve the above objects, a faucet diverter of the present invention is coupled to a faucet and including a main body, an inlet part, a first outlet part, a second outlet part and a control part.

The main body is composed of a first channel, a second channel, a third channel, a first assembly part, a second assembly part, a third assembly part, and a fourth assembly part.

The first outlet part consists of a pipe member, a positioning member, a first rotary member, a second rotary member and an outlet head.

The second outlet part is formed by a baffle plate and a spray head.

The control part includes a valve, a disc and an operation member.

For connecting the faucet diverter to an outlet of a faucet, the inlet part is arranged at the first assembly part of the main body. The first outlet part is disposed on the second assembly part of the main body and the second outlet part is set on the third assembly part of the main body. As to the control part, it is disposed on the fourth assembly part of the main body.

The outlet head of the first outlet part can be turned around 180 degrees by the assembly of the first rotary member with the second rotary member. The outlet head is connected to a hose and then the water is discharged through the outlet head.

The spray head of the second outlet part is arranged with spray holes and a closed portion. By rotating the control part, the water flow is switched to pass through the first channel and the spray holes for being discharged. Or the water flow is switched to flow through the third channel toward the closed portion to be stopped. Once the water flow is switched to the second channel and toward the first outlet part by rotating the control part, the water flow passes through a first accessory channel of the first rotary member and a second accessory channel of the second rotary member to be discharged by the outlet head.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein

FIG. 5-1 is a cross sectional view of an embodiment during spraying according to the present invention;

FIG. 5-2 is another cross sectional view of an embodiment while spraying according to the present invention;

FIG. 7-1 is another cross sectional view of an embodiment while water flow is discharged through a first outlet part according to the present invention;

DETAILED DESCRIPTION OF THE PREFERRED EMBODIMENT

Figure 1:
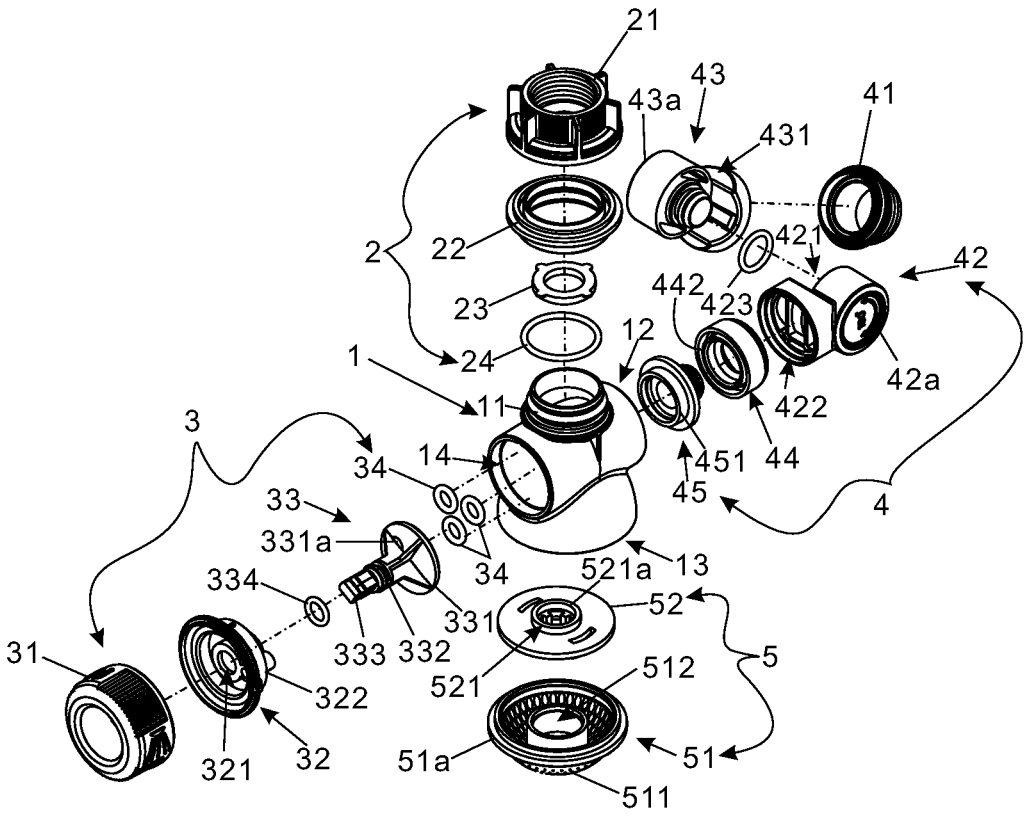
FIG. 1 is an explosive view of an embodiment according to the present invention.

Refer from FIG. 1 to FIG. 7, a faucet diverter of the present invention includes a main body 1, an inlet part 2, a first outlet part 4, a second outlet part 5 and a control part 3.

The main body 1 consists of a first channel 141*a*, a second channel 142*a*, a third channel 143*a*, a first assembly part 11, a second assembly part 12, a third assembly part 13, and a fourth assembly part 14.

The first outlet part 4 is composed of a pipe member 44, a positioning member 45, a first rotary member 42, a second rotary member 43 and an outlet head 41.

The second outlet part 5 is formed by a baffle plate 52 and a spray head 51.

The control part 3 includes a valve 33, a disc 32 and an operation member 31.

The inlet part 2 consists of a connector 21, a ring 22, a washer 23 and a seal ring 24. The inlet part 2 is disposed on the first assembly part 11 of the main body 1 for being connected to the faucet. The first outlet part 4 is arranged at the second assembly part 12 of the main body 1 and the second outlet part 5 is set on the third assembly part 13 of the main body 1. As to the control part 3, it is connected to the fourth assembly part 14 of the main body 1.

The main body 1 is further disposed with a first inlet 141, a second inlet 142 and a third inlet 143 communicating with different channels respectively. The first inlet 141 is communicating with the first channel 141*a*, the second inlet 142 is communicating with the second channel 142*a*, and the third inlet 143 is communicating with the third channel 143*a*. The first inlet 141, the second inlet 142 and the third inlet 143 are arranged with a seal ring 34 respectively.

The valve 33 is disposed with a round disc 331. The round disc 331 is arranged with a hole 331*a*. The round disc 331 is extended to form a shaft 332. One end of the shaft 332 is extended to form a locking portion 333. A seal ring 334 is set between the locking portion 333 and the shaft 332.

Figure 7:
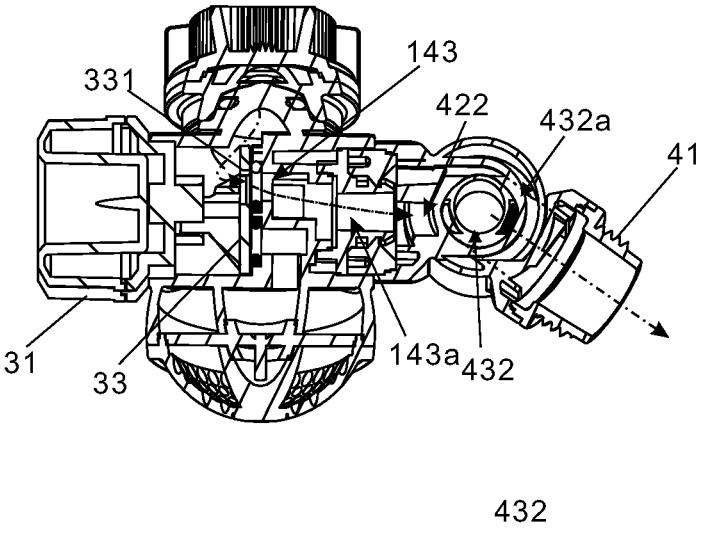
FIG. 7 is a cross sectional view of an embodiment while water flow is discharged through a first outlet part according to the present invention.
Figures 1, 7:
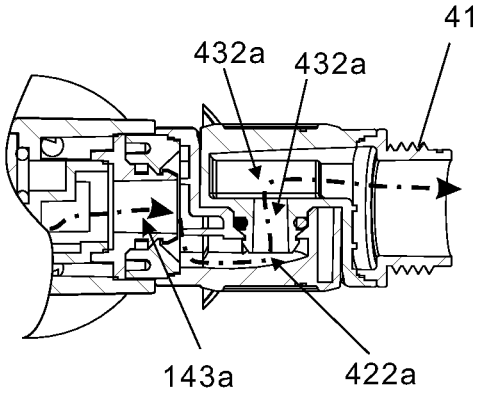

The first rotary member 42 is disposed with a first joining portion 422, a first pivot shaft 42*a* and a pivot portion 421. As shown in FIG. 7-1, the pivot portion 421 is arranged with a first accessory channel 422*a*. The second rotary member 43 includes a second pivot shaft 43*a* and a second pivot portion 431. A tubular portion 432 is disposed on the second pivot shaft 43*a*.

The pipe member 44 consists of a connecting portion 441, an insert 442 and a passage portion 443. The connecting portion 441 is extended to form the insert 442 and the insert 442 is extended to form the passage portion 443.

The positioning member 45 includes a first peripheral portion 451, a second peripheral portion 452 and a connection portion 453, which are all concentric circles with through holes. An outer diameter of the first peripheral portion 451 and an outer diameter of the connection portion 453 are smaller than an outer diameter of the second peripheral portion 452. This is due to that one end of the second peripheral portion 452 is extended to form the first peripheral portion 451 while the other end of the second peripheral portion 452 is extended to form the connection portion 453.

Figure 6:
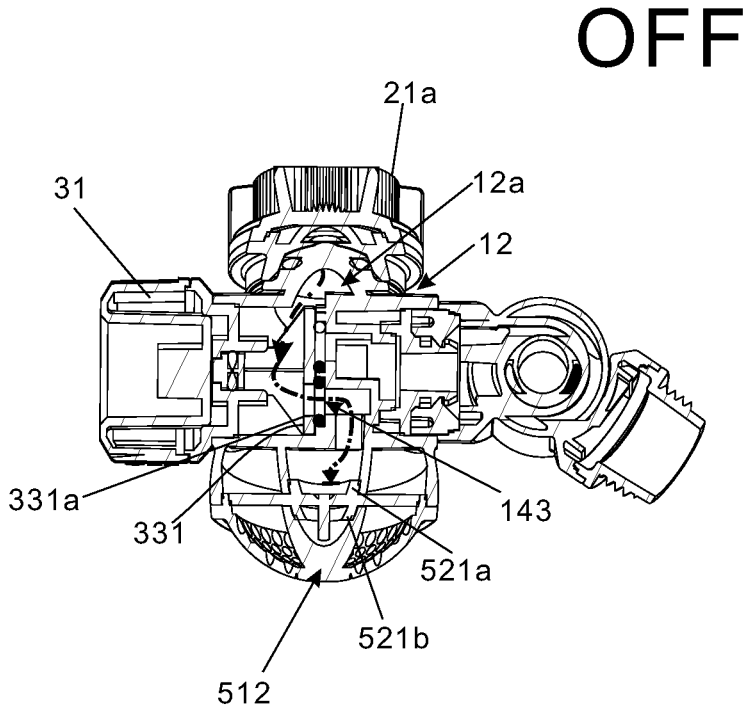
FIG. 6 is a cross sectional view of an embodiment of the present invention in the state that water flow is stopped.

The baffle plate 52 is disposed with a sleeve portion 521 that includes an upper portion 521*a* and a lower portion 521*b*, as shown in FIG. 6. The upper portion 521*a* and the lower portion 521*b* are formed by extension of a center of the baffle plate 52 toward two sides respectively. The spray head 51 is composed of an edge part 51*a*, spray holes 511 and a closed portion 512. The edge part 51*a* is formed by extension of one end of the spray head 51.

While in use, the faucet diverter of the present invention is assembled by the following way. First, the seal ring 24 of the inlet part 2 is disposed around an outer diameter of the first assembly part 11 of the main body 1 and the washer 23 is mounted into an inner diameter of the first assembly part 11. Then the ring 22 is threaded on the first assembly part 11 and a bottom of the connector 21 is connected to the ring 22 by ultrasonic welding.

Next the connecting portion 441 of the pipe member 44 of the first outlet part 4 is fixed with and mounted into an inner diameter of the second assembly part 12 by ultrasonic welding. Then the connection portion 453 on the second peripheral portion 452 is arranged around an outer diameter of the passage portion 443. An inner diameter of the first pivot shaft 42*a* is tightly connected to an outer diameter of the first peripheral portion 451 of the positioning member 45 by ultrasonic welding. Thereby the first rotary member 42 can rotate 360 degrees along the radial direction in relative to the second assembly part 12. After being arranged with the seal ring 423, an outer diameter of the tubular portion 432 of the second pivot shaft 43*a* is pivotally arranged around the pivot portion 421 of the first pivot shaft 42*a*. Thereby the second rotary member 43 can be rotated 180 degrees after being pivotally connected to the first rotary member 42. At last, the outlet head 41 is closely connected to the second pivot portion 431 of the second rotary member 43 by ultrasonic welding. Thus the assembly of the first outlet part 4 with the second assembly part 12 of the main body 1 is completed.

Figure 4:
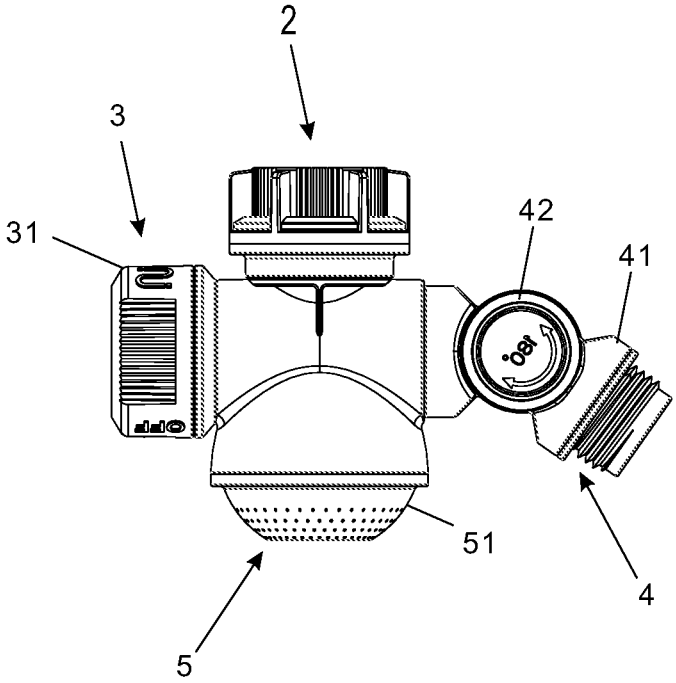
FIG. 4 is an assembled view of an embodiment according to the present invention.

As to the assembling of the second outlet part 5, the closed portion 512 of the spray head 51 is aligned with the lower portion 521*b* of the sleeve portion 521 of the baffle plate 52. The lower portion 521*b* is firmly mounted into and connected to the closed portion 512 by ultrasonic welding. Then the edge part 51*a* of the spray head 51 is tightly connected to an inner diameter of the third assembly part 13 by ultrasonic welding. The assembled view is shown in FIG. 4.

As to the control part 3, the seal ring 334 is arranged around the locking portion 333 of the valve 33. Then the locking portion 333 is passed through an insertion hole 321 of the disc 32 to be aligned and locked with an assembly hole 311 of the operation member 31. Next an edge portion 322 of the disc 32 is firmly connected to an inner diameter of the fourth assembly part 14 by ultrasonic welding. Moreover, the first inlet 141, the second inlet 142 and the third inlet 143 of the fourth assembly part 14 are assembled with the seal ring 34 respectively and then are covered by the round disc 331.

The switch and control of channels in an embodiment of the present invention features on that the channels are switched by rotating the operation member 31 of the control part 3. While the operation member 31 being rotated, the hole 331*a* on the round disc 331 is aligned with the first inlet 141, the second inlet 142 or the third inlet 143 being selected. Thus the water flow is guided and flowed into the channel selected.

Moreover, the main body 1 is communicated with the first inlet 141, the second inlet 142 and the third inlet 143 of three different channels respectively. Through the first inlet 141, the water flow is guided and flowed toward the second outlet part 5. The second inlet 142 allows the water flow passing toward the first outlet part 4. As to the third inlet 143, it guides the water flow flowing toward the closed portion 512 of the second outlet part 5.

Figure 8:
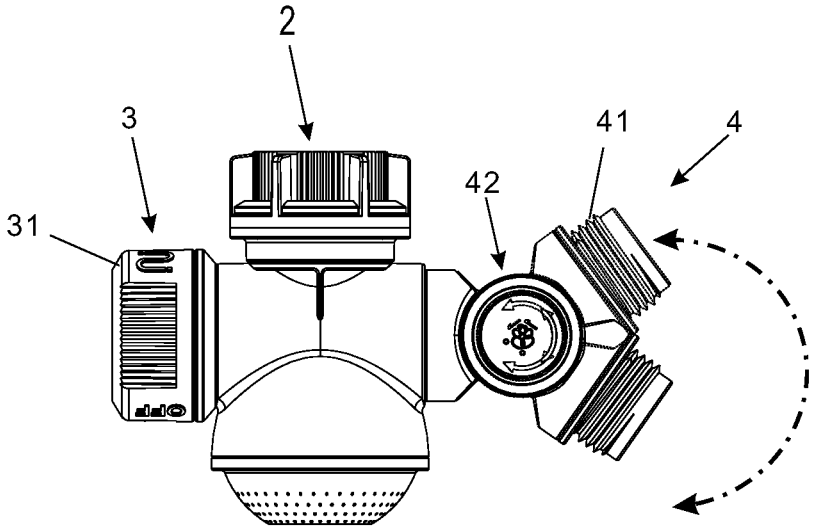
FIG. 8 is a schematic drawing showing rotation of a first outlet part of an embodiment according to the present invention.

While in use, the outlet head 41 of the first outlet part 4 can be turned around 180 degrees by the assembly of the first rotary member 42 with the second rotary member 43, as shown in FIG. 8. The outlet head 41 can be connected to a hose and then the water flows out through the outlet head 41.

Figure 2:
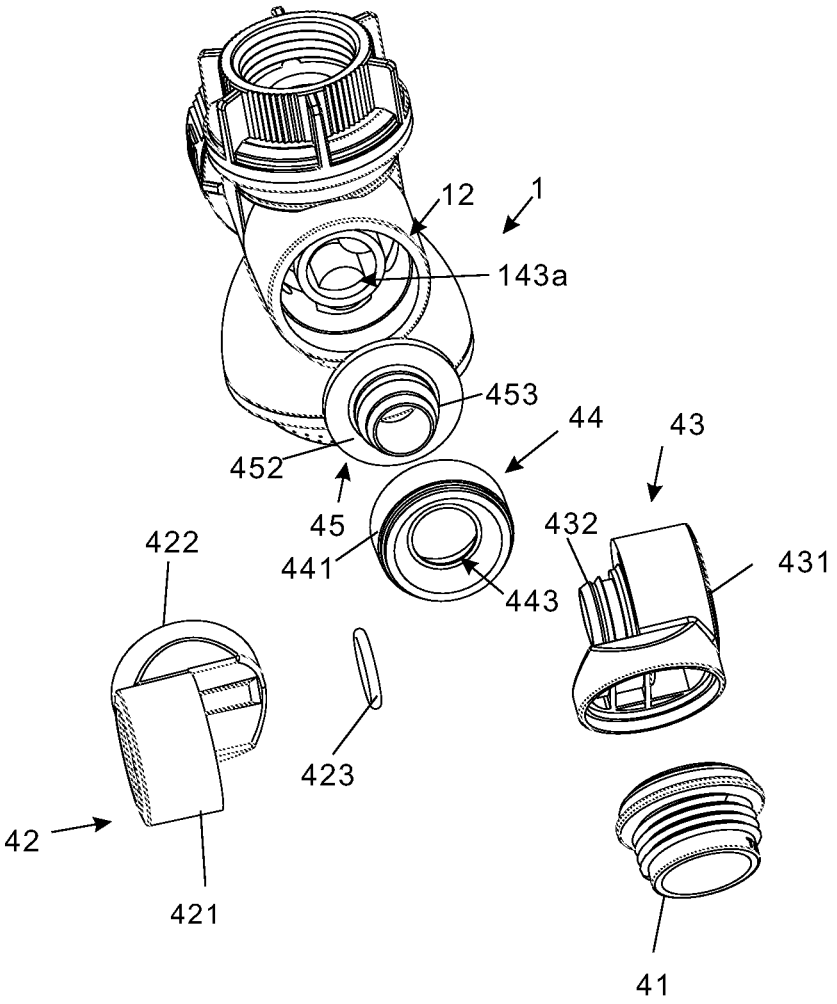
FIG. 2 is an explosive view of a first outlet part and a main body of an embodiment according to the present invention.
Figure 3:
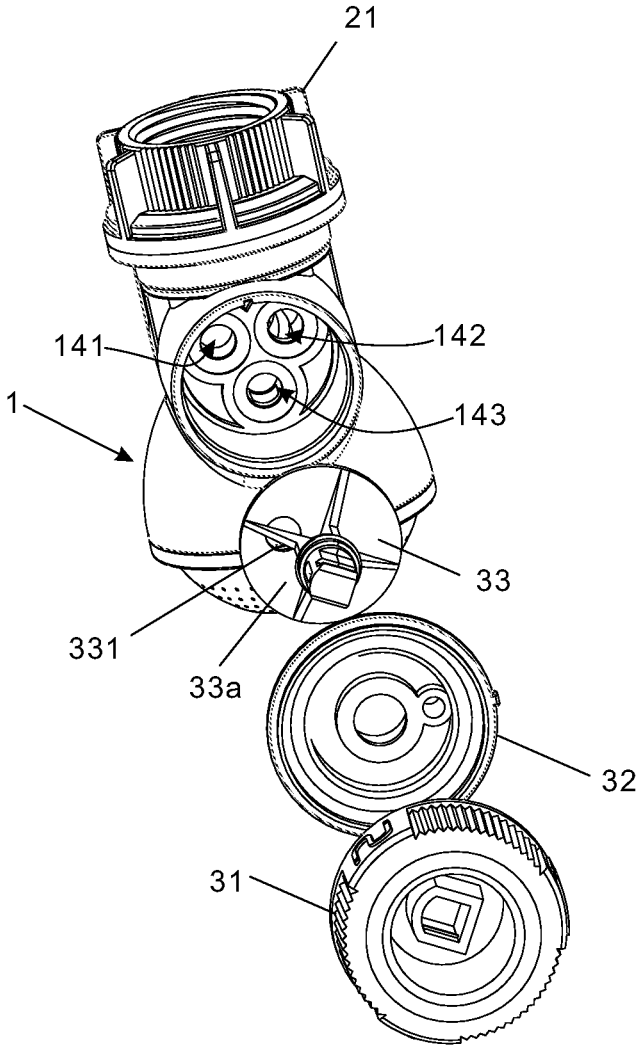
FIG. 3 is an explosive view of a control part and a main body of an embodiment according to the present invention.
Figure 5:
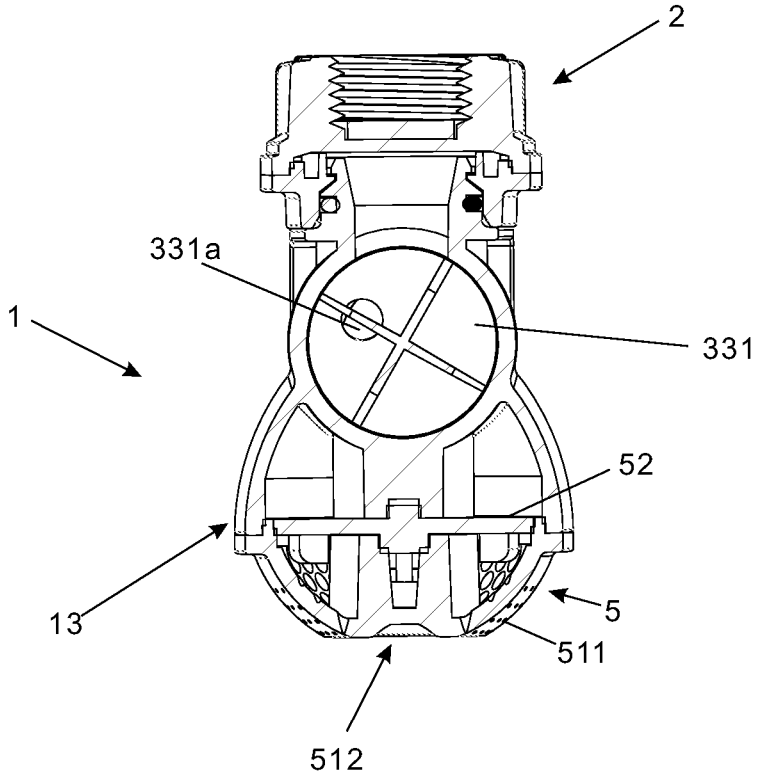
FIG. 5 is a partial cross sectional view of a control part and a main body of an embodiment according to the present invention.
Figures 1, 5:
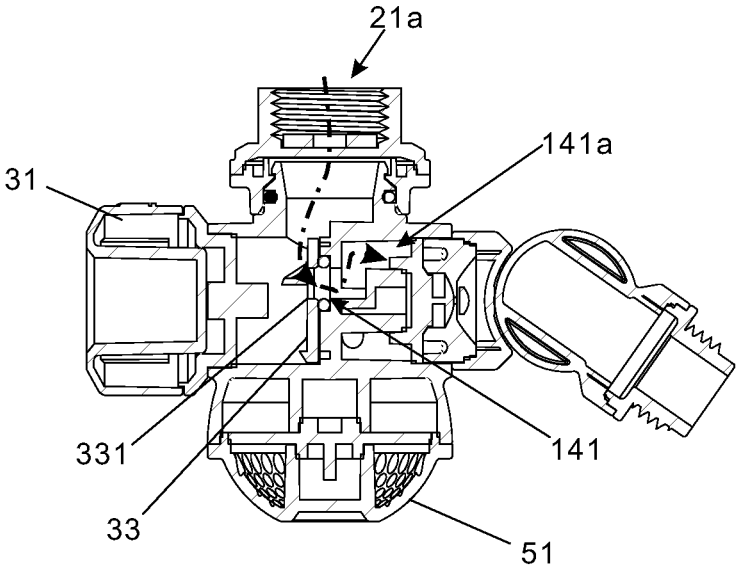
Figures 2, 5:
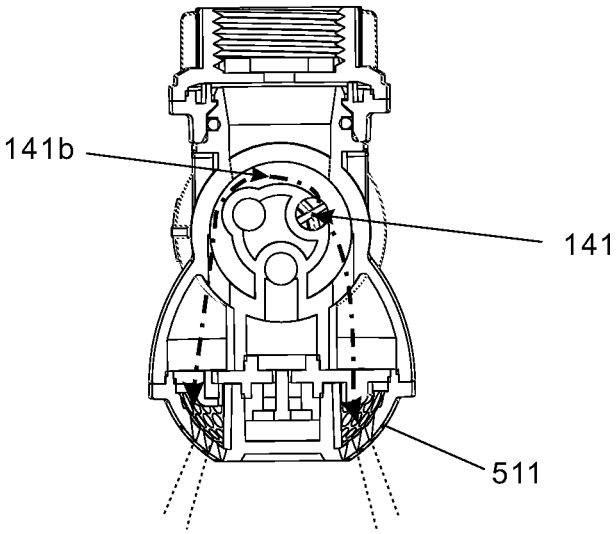

Refer to FIG. 5, FIG. 5-1 and FIG. 5-2, the water flow is switched to the first outlet part 4 or the second outlet part 5 by rotating the control part 3. Once the hole 331*a* on the round disc 331 is aligned with the first inlet 141, the water flow passes the first channel 141*a* toward a diversion channel 141*b* and then enters the spray holes 511 of the second outlet part 5 to be discharged. Refer to FIG. 6, if the hole 331*a* on the round disc 331 is aligned with the third inlet 143, the water flow enters the third channel 143*a* and flows toward the closed portion 512 of the second outlet part 5 to be stopped inside the closed portion 512. Or as shown in FIG. 7 and FIG. 7-1, the hole 331*a* on the round disc 331 is aligned with the second inlet 142. Then the water flow enters the second channel 142*a* and flows toward the first outlet part 4. After passing through the first accessory channel 422*a* of the first rotary member 42 and a second accessory channel 432*a* of the second rotary member 43, the water flow is discharged by the outlet head 41.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A faucet diverter for a faucet, comprising: a main body having a first channel, a second channel and a third channel disposed therein, wherein the first channel, the second channel and the third channel are separated from each other, wherein the main body further defines a first assembly part, a second assembly part, a third assembly part, and a fourth assembly part; an inlet part disposed on the first assembly part of the main body for being coupled to an outlet of the faucet; a first outlet part arranged at the second assembly part of the main body, wherein the first outlet part comprises a first rotary member, a second rotary member and an outlet head wherein the first rotary member is pivotally connected to the second rotary member, wherein the first rotary member comprises a first joining portion, a first pivot shaft and a pivot portion, wherein the second rotary member comprises a second pivot shaft having a tubular portion, wherein the tubular portion of the second pivot shaft has an outer diameter arranged pivotally around the pivot portion of the first pivot shaft such that the second rotary member is arranged to be rotated 180 degrees relative to the first rotary member; a second outlet part arranged at the third assembly part of the main body, wherein the second outlet comprises a baffle plate, a spray head aligned with the baffle plate, wherein the spray head has an edge part connected tightly to an inner diameter of the third assembly part; and a control part including a valve a disc having an insertion hole and an edge portion, an operation member having an assembly hole and a seal ring, wherein the disc forms a round disc having a hole, a shaft extended from the round disc and a locking portion extended from the shaft, wherein the seal ring is arranged around the locking portion of the valve and provided between the locking portion and the shaft, the locking portion passes through the insertion hole of the disc to be aligned and locked with the operation member through the assembly hole; wherein the edge portion of the disc is tightly connected to an inner diameter of the fourth assembly part, wherein the control part is connected to the fourth assembly part of the main body, wherein the spray head of the second outlet part further has a plurality of spray holes and a closed portion, wherein the main body has a first inlet communicated with the first channel, a second inlet communicated with the second channel and a third inlet communicated with the third channel, wherein the hole of the round disc is communicated with the inlet part, the first channel is communicated with the second outlet part, the second channel is communicated with the first outlet part and the third channel is blocked by the closed portion of the spray head of the second outlet part; wherein the disc of the control part is rotated to selectively align with one of the first inlet, second inlet, and said third inlet, wherein when the disc of the control part is rotated to align the hole of the round disc with the first inlet, the water flow from the inlet part is allowed to flow to the second outlet part; when the disc of the control part is rotated to align the hole of the round disc with the second inlet, the water flow from the inlet part is allowed to flow to the first outlet part; and when the disc of the control part is rotated to align the hole of the round disc with the third inlet, the water flow from the inlet part is blocked by the closed portion of the spray head of the second outlet part.

2. The faucet diverter, as recited in claim 1, wherein the first outlet part further comprises a pipe member and a positioning member, wherein the pivot portion of the first rotary member has a first accessory channel provided therein, the pipe member comprises a connecting portion, an insert extended from the connecting portion and a passage portion extended from the insert, the positioning member comprises a first peripheral portion, a second peripheral portion and a connection portion which are concentric circles with each other, wherein each of the first peripheral portion and the connection portion has an outer diameter smaller than an outer diameter of the second peripheral portion, and the first peripheral portion is extended from one end of the second peripheral portion and the connection portion is extended from another end of the second peripheral portion, wherein the connecting portion of the pipe member of the first outlet part is fixed with an inner diameter of the second assembly part, the second peripheral portion of the positioning member is arranged around an outer diameter of the passage portion and the first pivot shaft has an inner diameter connected tightly to an outer diameter of the first peripheral portion of the positioning member such that the first rotary member is capable of rotating 360 degrees along the radial direction in relative to the second assembly part of the main body.

3. The faucet diverter, as recited in claim 2, wherein the baffle plate has a sleeve portion, wherein the sleeve portion has an upper portion and a lower portion extended from the upper portion, wherein the lower portion is provided in an inner diameter of the closed portion and the edge part of the spray head is tightly connected to the inner diameter of the third assembly part.

4. The faucet diverter, as recited in claim 1, wherein the baffle plate has a sleeve portion, wherein the sleeve portion has an upper portion and a lower portion extended from the upper portion, wherein the lower portion is provided in an inner diameter of the closed portion and the edge part of the spray head is tightly connected to the inner diameter of the third assembly part.

* * * * *